US009093781B2

(12) United States Patent
Liu

(10) Patent No.: US 9,093,781 B2
(45) Date of Patent: Jul. 28, 2015

(54) COMPLEMENTARY CONNECTOR ASSEMBLY EMPLOYING A MAGNETIC FIXING COMPONENT

(71) Applicant: Wistron Corporation, New Taipei (TW)

(72) Inventor: Bu Liu, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 68 days.

(21) Appl. No.: 14/033,531

(22) Filed: Sep. 23, 2013

(65) Prior Publication Data

US 2014/0315395 A1 Oct. 23, 2014

(30) Foreign Application Priority Data

Apr. 22, 2013 (CN) ..... 2013 1 0141598

(51) Int. Cl.
*H01R 11/30* (2006.01)
*H01R 13/62* (2006.01)

(52) U.S. Cl.
CPC ..... *H01R 13/6205* (2013.01)

(58) Field of Classification Search
CPC ..... H01R 13/6205; H01R 11/30
USPC ..... 439/305, 23, 38, 39
See application file for complete search history.

(56) References Cited

U.S. PATENT DOCUMENTS

| | | | | |
|---|---|---|---|---|
| 7,056,127 | B2 * | 6/2006 | Suzuki et al. | 439/39 |
| 8,105,090 | B1 * | 1/2012 | Ding | 439/17 |
| 2013/0040469 | A1 * | 2/2013 | Hsu | 439/39 |

* cited by examiner

*Primary Examiner* — Vanessa Girardi
(74) *Attorney, Agent, or Firm* — Winston Hsu; Scott Margo

(57) ABSTRACT

The present invention discloses a connector assembly includes a connector and a plug. The connector is disposed on the circuit board and includes an insulating socket with a slot. The slot includes an inner first end and an outer second end, and an inner diameter of the second end of the slot is greater than an inner diameter of the first end of the slot. The plug is connected to an end of a power cable for plugging into the connector. The plug includes an insulating portion and a plug portion exposed outside the insulating portion. The plug portion includes a first end which is close to the insulating portion and a second end which is far way from the insulating portion, and an outer diameter of the first end of the plug portion is greater than an outer diameter of the second end of the plug portion.

18 Claims, 6 Drawing Sheets

COMPLEMENTARY CONNECTOR ASSEMBLY EMPLOYING A MAGNETIC FIXING COMPONENT

BACKGROUND OF THE INVENTION

1. Field of the Invention

The present invention relates to a connector assembly and an electronic device with the connector assembly, and more specifically, to a connector assembly whose two connected connectors can be separated from each other as being forced and an electronic device with the connector assembly.

2. Description of the Prior Art

In general, a battery of a conventional portable electronic device cannot provide enough electricity for a long time. Therefore, as a user needs to perform a complicated work which spends system resources in a long time, the portable electronic device has to use an external AC power to provide enough electricity to extend the operating time. However, a normal AC power socket is often disposed on a wall or on an extension cord extending to the ground or the desktop near the user, so as to be plugged by the power cable of the portable electronic device. Hence, the power cable occupies some space inevitably, so that the power cable might be pulled by the user or other people easily. Moreover, when the user moves the portable electronic device and forgets to remove the power cable in advance, the power cable is pulled and the plug of the power cable drags a connector on the portable electronic device by a lateral force, such as a shear force, resulting in damaging solder joints of the connector and a circuit board. As the solder joints are damaged, the portable electronic device may not be charged anymore, so that the whole circuit board has to be discarded and to be replaced by a new circuit board. Therefore, it is an important issue to design a connector assembly for protecting the connector.

SUMMARY OF THE INVENTION

The present invention is to provide a connector assembly whose plug is separated from a connector as being forced, to solve above problems.

According to the disclosure, the connector assembly includes a connector and a plug. The connector is disposed on a circuit board. The connector includes an insulating socket with a slot, and the slot includes an inner first end and an outer second end. An inner diameter of the second end of the slot is greater than an inner diameter of the first end of the slot. The plug is connected to an end of a power cable for plugging into the connector. The plug includes an insulating portion and a plug portion exposed outside the insulating portion. The plug portion includes a first end close to the insulating portion and a second end far away from the insulating portion. An outer diameter of the first end of the plug portion is greater than an outer diameter of the second end of the plug portion, wherein a shape formed between the first end and the second end of the plug portion of the plug conforms to a shape formed between the second end and the first end of the connector, so that the plug portion of the plug is complementarily inserted into the slot of the connector to be located.

According to the disclosure, a first conductive portion and at least one second conductive portion are formed inside the slot of the connector, the first conductive portion and the at least one second conductive portion are separated from each other, a third conductive portion and a fourth conductive portion are formed on the plug portion of the plug, the third conductive portion and the fourth conductive portion are separated from each other, and the first conductive portion and the at least one second conductive portion contact the third conductive portion and the fourth conductive portion respectively as the plug portion is inserted into the slot.

According to the disclosure, the at least one second conductive portion is a metal clip.

According to the disclosure, the plug portion of the plug is formed as a conical shape.

According to the disclosure, a radial section of the plug portion is a circular section.

According to the disclosure, a radial section of the plug portion is a polygonal section.

According to the disclosure, the connector assembly further includes at least one fixing component disposed between the connector and the plug for increasing stability of connection of the connector and the plug.

According to the disclosure, the at least one fixing component comprises at least one magnetic attractive component disposed on one of the connector and the plug, and a corresponding magnetic component disposed on the other one of the connector and the plug.

According to the disclosure, the magnetic attractive component is a magnet or a substance containing iron, and the corresponding magnetic component is a magnet or a substance containing iron.

According to the disclosure, an electronic device includes a casing, a circuit board and a connector assembly. The circuit board is disposed inside the casing. The connector assembly includes a connector and a plug. The connector is disposed on the circuit board. The connector includes an insulating socket with a slot, and the slot includes an inner first end and an outer second end. An inner diameter of the second end of the slot is greater than an inner diameter of the first end of the slot. The plug is connected to an end of a power cable for plugging into the connector. The plug includes an insulating portion and a plug portion exposed outside the insulating portion. The plug portion includes a first end close to the insulating portion and a second end far away from the insulating portion. An outer diameter of the first end of the plug portion is greater than an outer diameter of the second end of the plug portion, wherein a shape formed between the first end and the second end of the plug portion of the plug conforms to a shape formed between the second end and the first end of the connector, so that the plug portion of the plug is complementarily inserted into the slot of the connector to be located.

The plug of the electronic device of the present invention is able to separate from the connector automatically as the plug is inserted into the connector and being pulled by the external force because of structural design of the conical plug portion of the plug and the conical slot of the connector. Therefore, it solves the conventional problem that the solder joints of the connector and the circuit board are damaged because the conventional plug connected to the power cable drags the connector by the lateral force as the power cable is pulled accidentally.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
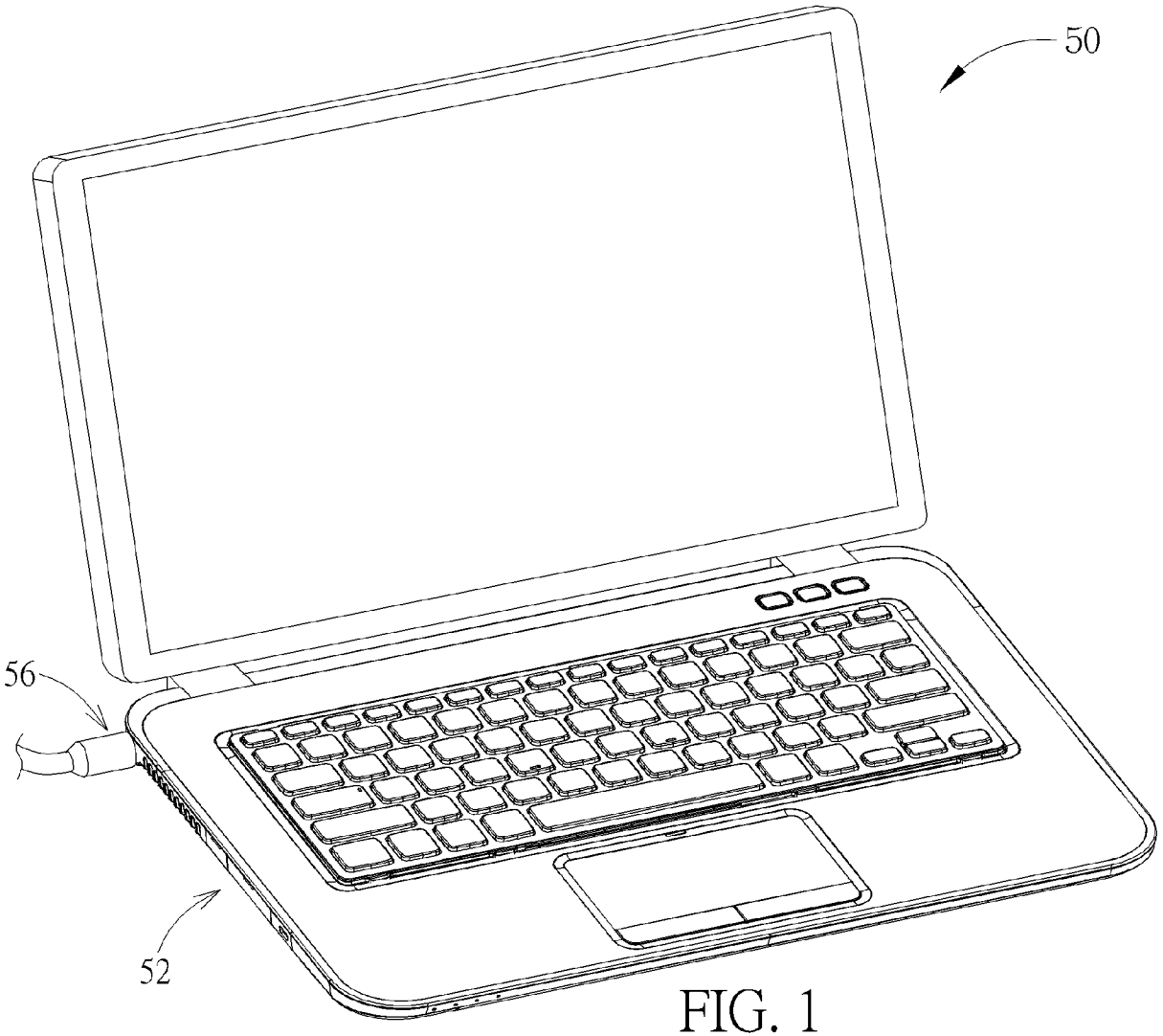
FIG. 1 is a diagram of an electronic device according to an embodiment of the present invention.
Figure 2:
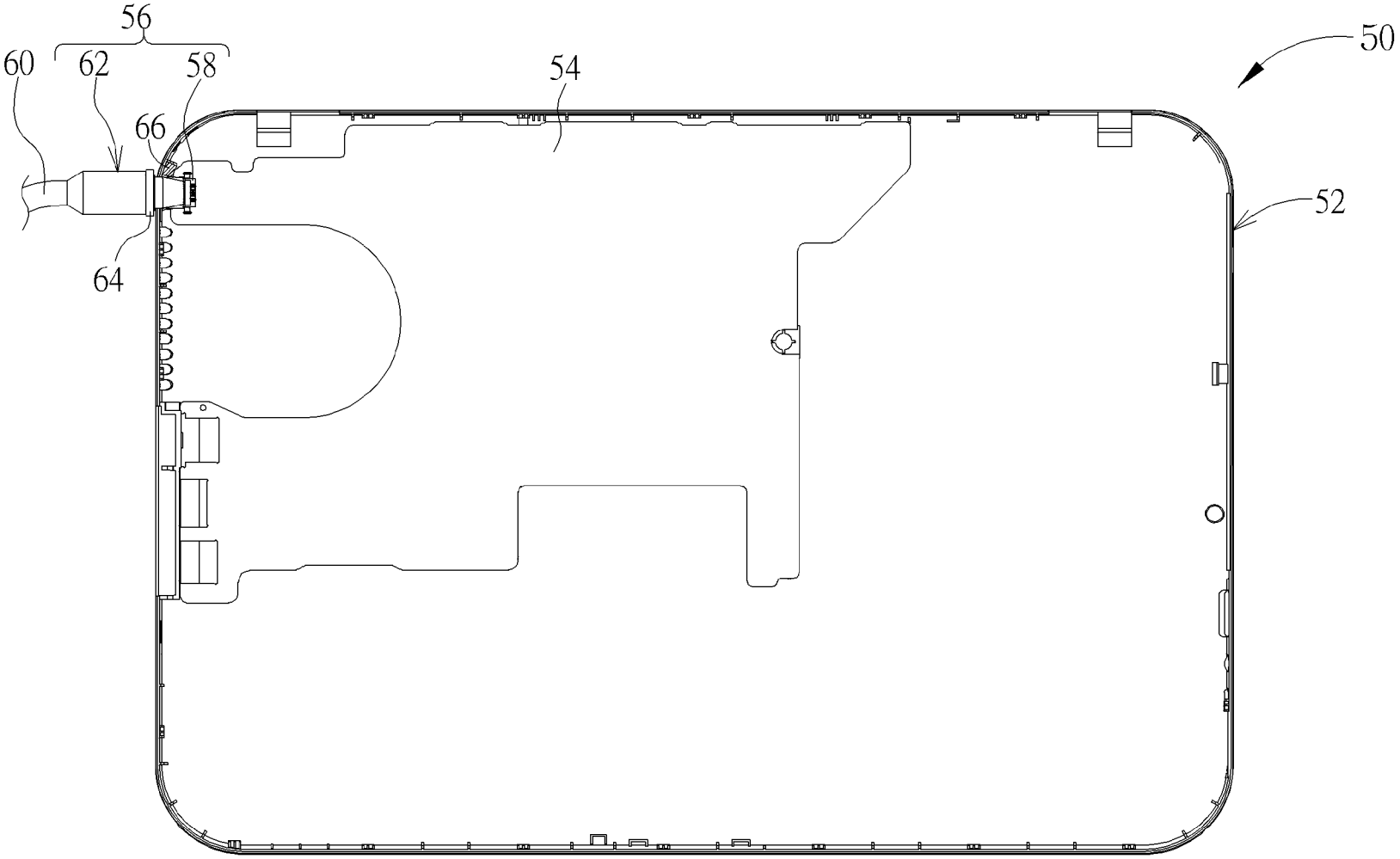
FIG. 2 is an internal structural diagram of the electronic device according to the embodiment of the present invention.

Please refer to FIG. 1 and FIG. 2. FIG. 1 is a diagram of an electronic device 50 according to an embodiment of the present invention. FIG. 2 is an internal structural diagram of the electronic device 50 according to the embodiment of the present invention. The electronic device 50 can be a portable notebook computer, but is not limited to it. For example, the electronic device 50 also can be a desktop computer or other portable or fixed electronic devices. The electronic device 50 includes a casing 52, a circuit board 54 and a connector assembly 56. The casing 52 is for covering internal electronic components of the electronic device 50, such as a CPU, a hard drive, a fan, a memory, an expansion card, and soon. The circuit board 54 is disposed inside the casing 52, and the circuit board 54 can be a motherboard. The electronic components, such as a CPU, a hard drive, a fan, a memory, an expansion card, and so on, can be disposed on or coupled to the circuit board 54. The connector assembly 56 includes a connector 58 and a plug 62 which is connected to an end of a power cable 60. As the plug 62 is connected to the connector 58, the external electricity can be transmitted to the electronic device 50 by the power cable 60.

Figure 3:
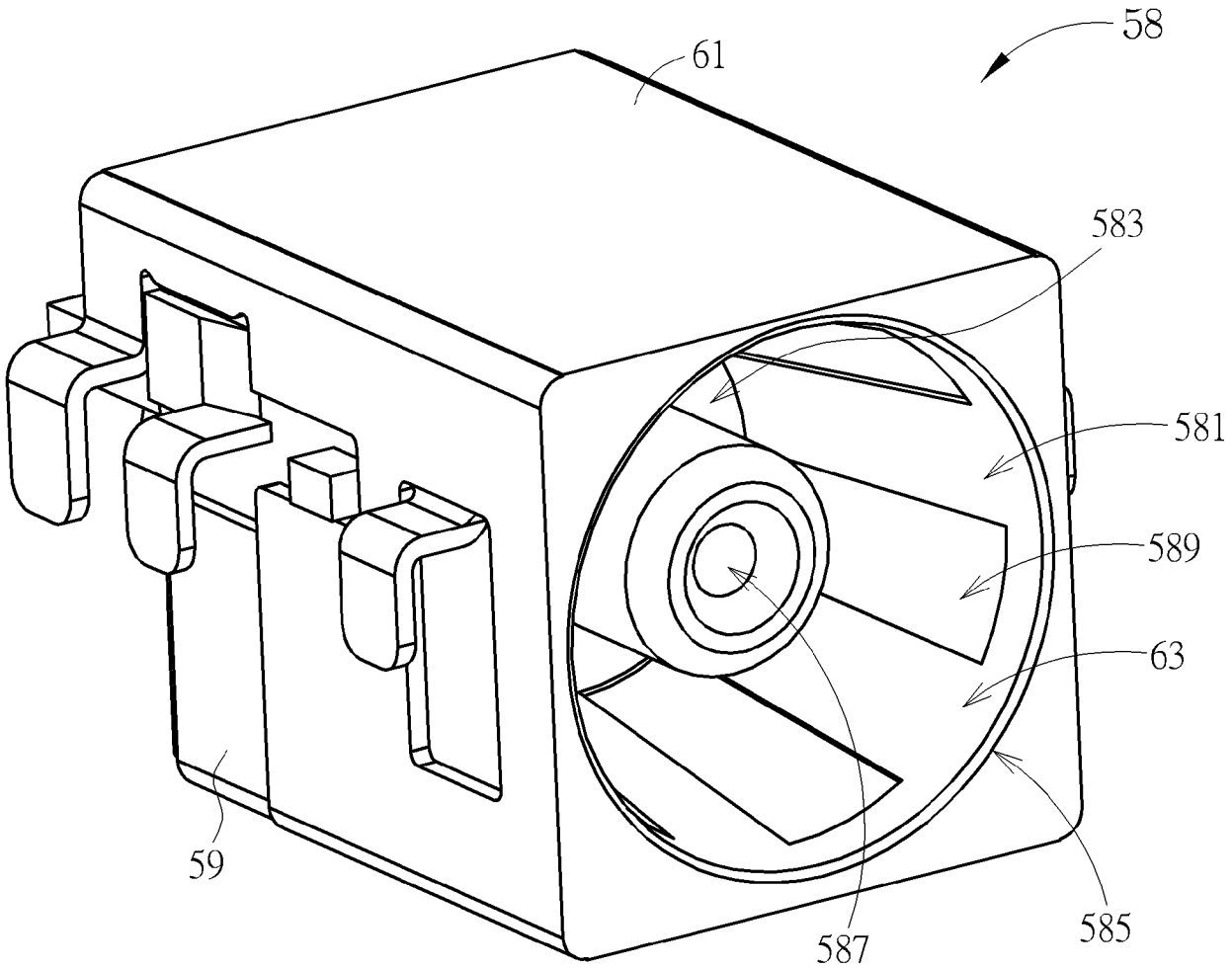
FIG. 3 is a diagram of a connector according to the embodiment of the present invention.
Figure 4:
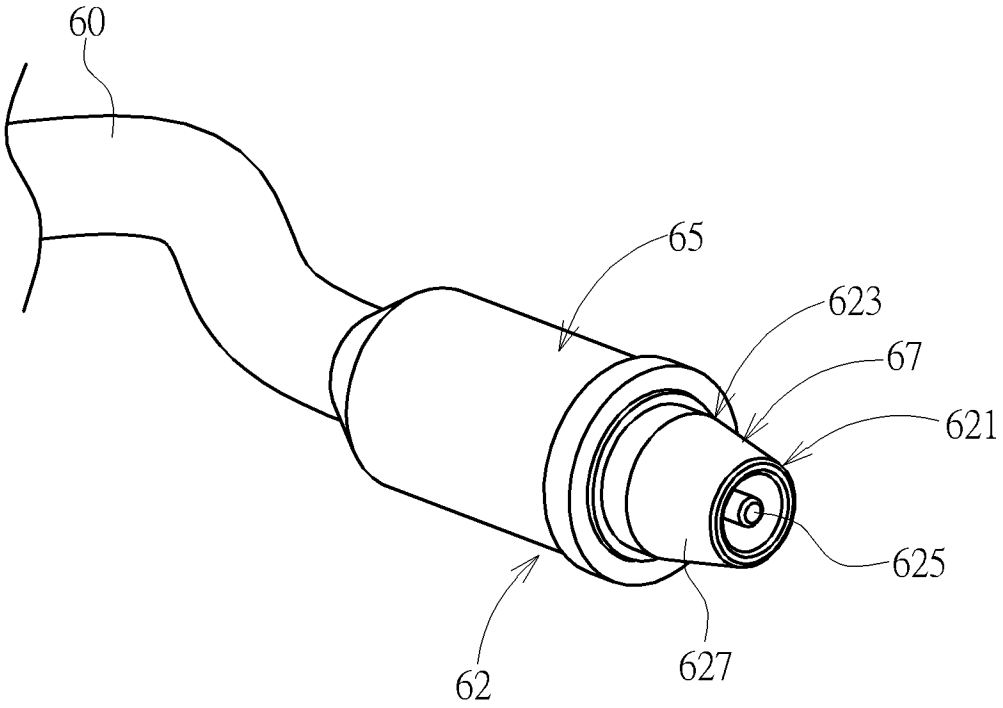
FIG. 4 is a diagram of a power cable and a plug according to the embodiment of the present invention.
Figure 5:
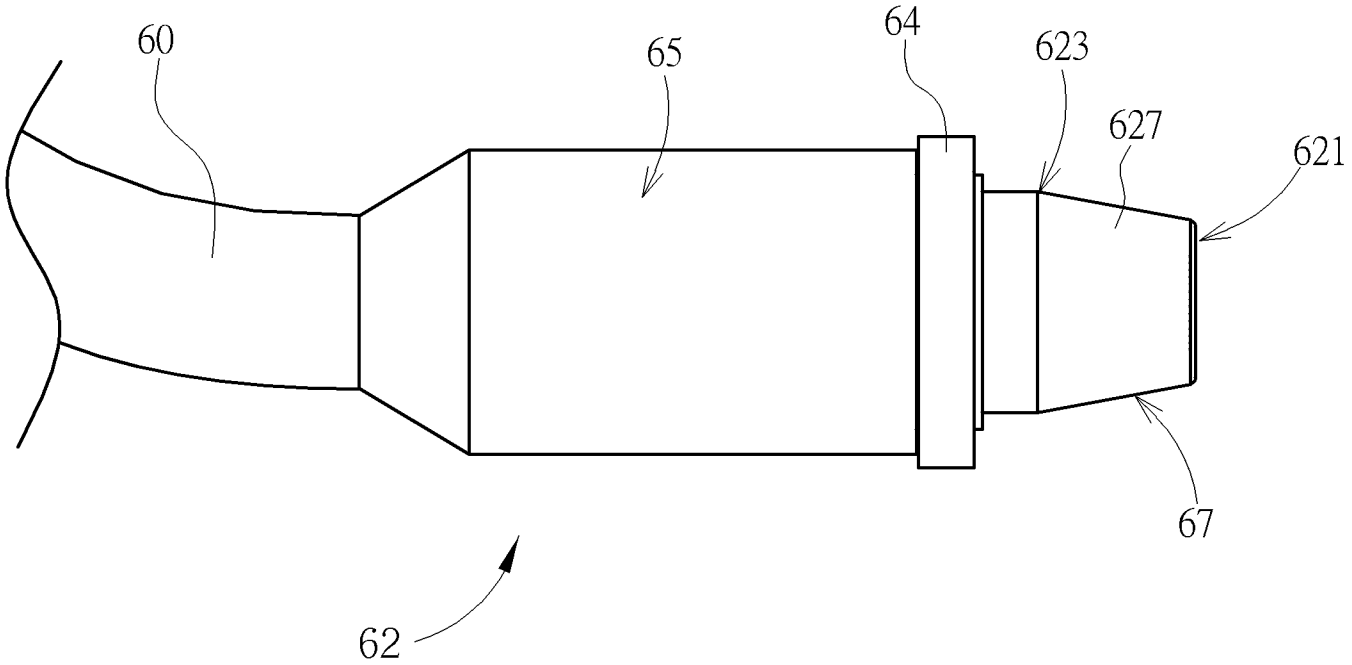
FIG. 5 is a side view of the power cable and the plug according to the embodiment of the present invention.

Please refer to FIG. 3 to FIG. 5. FIG. 3 is a diagram of the connector 58 according to the embodiment of the present invention. FIG. 4 is a diagram of the power cable 60 and the plug 62 according to the embodiment of the present invention. FIG. 5 is a side view of the power cable 60 and the plug 62 according to the embodiment of the present invention. The connector 58 is disposed on a side edge of the circuit board 54 and exposed outside the electronic device 50. The connector 58 can be a socket-type connector, and the connector 58 includes an insulating socket 59 and a metal casing 61 covering the insulating socket 59. The insulating socket 59 includes a slot 63, and an inner wall 581 is formed around the slot 63. A first end 583 of the slot 63 is entirely or partly enclosed inward, and a second end 585 of the slot 63 is open outward. An inner diameter of the second end 585 of the slot 63 is greater than an inner diameter of the first end 583 of the slot 63. That is, an inner diameter of the inner wall 581 of the connector 58 decreases inwardly and gradually, so as to form a frustoconical space inside the inner wall 581.

As show in FIG. 4, the plug 62 is connected to the end of the power cable 60 and for inserting into the connector 58. The plug 62 includes an insulating portion 65 and a plug portion 67 exposed outside the insulating portion 65. The plug portion 67 can be a metal plug portion 67. The plug portion 67 includes a first end 623 close to the insulating portion 65 and a second end 621 far away from the insulating portion 65. An outer diameter of the first end 623 of the plug portion 67 is greater than an outer diameter of the second end 621 of the plug portion 67. That is, an outer diameter of the plug portion 67 of the plug 62 decreases outwardly and gradually, so that the plug portion 67 is formed as a frustoconical shape. The frustoconical plug portion 67 conforms to the frustoconical slot 63 of the connector 58 complementarily. That is, a shape formed between the first end 623 and the second end 621 of the plug portion 67 of the plug 62 conforms to a shape formed between the second end 585 and the first end 583 of the connector 58 substantially, so that the plug portion 67 of the plug 62 is complementarily inserted into the slot 63 of the connector 58 to be located. The complementary structural design can make the plug portion 67 be pushed by a reaction force generated by the inner wall 581 to separate from the slot 63 along the inner wall 581 smoothly as the plug 62 is inserted into the slot 63, as shown in FIG. 3, and is pushed by an outer force accidentally.

In the present invention, the structures of the plug portion 67 of the plug 62 and the slot 63 of the connector 58 can be designed as other different shapes. For example, the slot 63 of the connector 58 can be formed as a conical structure, such as a pyramidal shaped structure, and the plug portion 67 of the plug 62 can complementarily be formed as a conical body, such as a pyramidal body. Any structural design configures that the inner diameter of the first end 583 of the slot 63 is less than the inner diameter of the second end 585 of the slot 63, and configures that the outer diameter of the first end 623 of the plug portion 67 is greater than the outer diameter of the second end 621 of the plug portion 67 is within the scope of the present invention. In addition, as shown in FIG. 3 and FIG. 4, in this embodiment, radial sections of the plug portion 67 of the plug 62 and of the slot 63 of the connector 58 can be circular sections, respectively, but are not limited to it. For example, the radial section of the plug portion 67 of the plug 62 can be a square section of a polygonal section. That is, it can be designed as a shape suitable for a USB connector, and it depends on practical design demands.

As shown in FIG. 3 an FIG. 4, a first conductive portion 587 and at least one second conductive portion 589 are formed inside the slot 63 of the connector 58, the first conductive portion 587 is in a middle of the slot 63, the at least one second conductive portion 589 is on the inner wall 581, and the first conductive portion 587 and the at least one second conductive portion 589 are separated from each other. Accordingly, a third conductive portion 625 and a fourth conductive portion 627 around the third conductive portion 625 are formed on the plug portion 67 of the plug 62. The third conductive portion 625 is in a middle of the plug portion 67 of the plug 62. The third conductive portion 625 and the fourth conductive portion 627 are separated from each other. The first conductive portion 587 and the at least one second conductive portion 589 contact the third conductive portion 625 and the fourth conductive portion 627 respectively as the plug portion 67 of the plug 62 is inserted into the slot 63 of the connector 58. Therefore, the first conductive portion 587 is electrically connected to the third conductive portion 625, and the at least one second conductive portion 589 is electrically connected to the fourth conductive portion 627. As a result, the external electricity coupled to the power cable 60 can be transmitted to the circuit board 54 by an electrical connection of the first conductive portion 587, the at least one second conductive portion 589, the third conductive portion 625 and the fourth conductive portion 627, so as to provide the electronic device 50 with the electricity. The first conductive portion 587 and the third conductive portion 625 can be designed as positive electrodes, and the at least one second conductive portion 589 and the fourth conductive portion 627 can be designed as negative electrodes, but are not limited to it. Furthermore, each second conductive portion 589 can be a metal clip for clipping the fourth conductive portion 627 as the plug portion 67 is inserted in to the slot 63, so that the plug 62 is inserted into the connector 58 stably.

Figure 6:
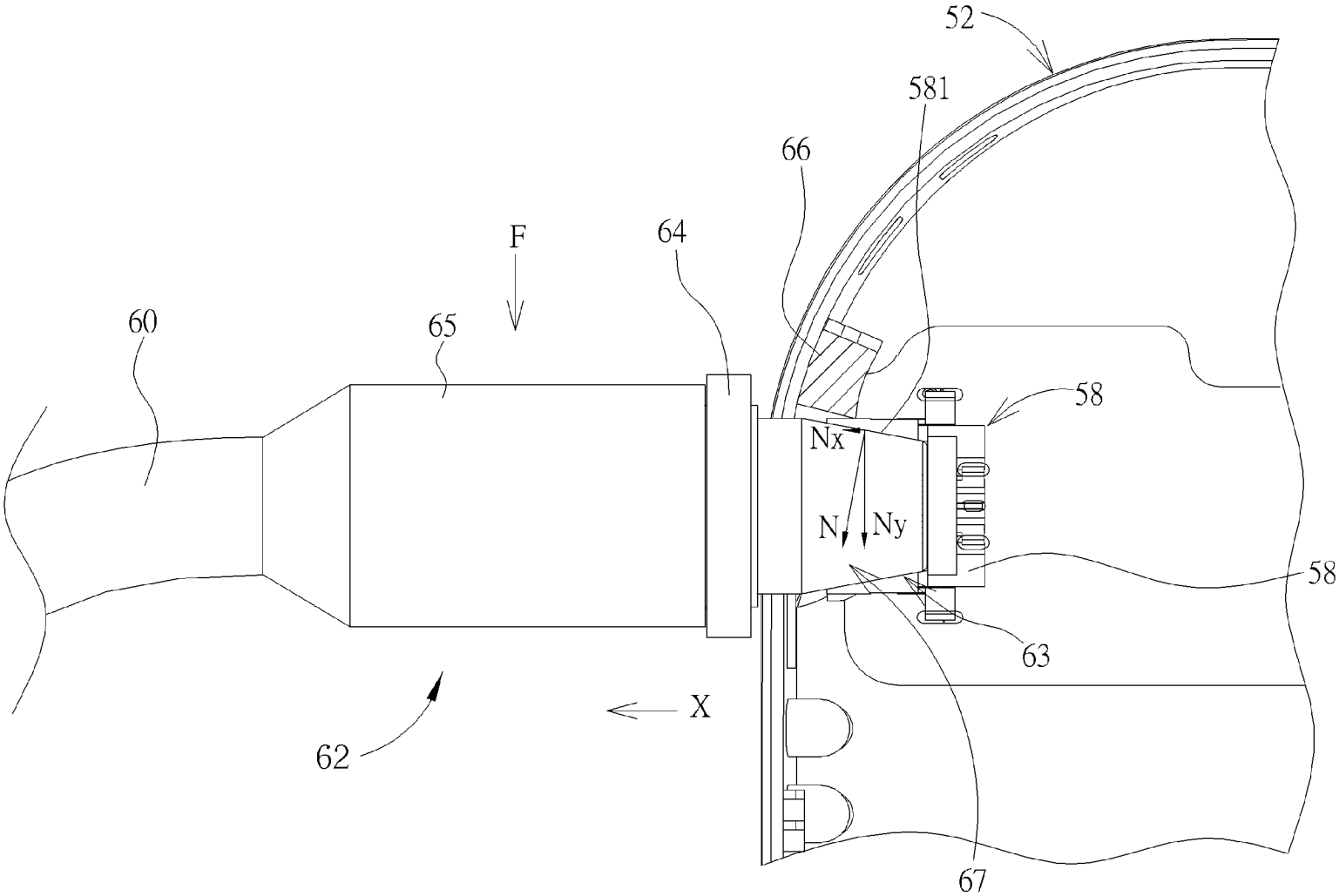
FIG. 6 is a diagram illustrating that the plug is inserted into the connector according to the embodiment of the present invention.

Please refer to FIG. 6. FIG. 6 is a diagram illustrating that the plug 62 is inserted into the connector 58 according to the embodiment of the present invention. Because the plug portion 67 of the plug 62 is formed as the conical shape, and the slot 63 of the connector 58 is complementarily formed as the conical shape, the plug portion 67 can be smoothly inserted into the slot 63 to connect with the slot 63. However, as the plug 62 is accidentally dragged by a lateral force F which is not parallel to an axis of the plug portion 67, the plug portion 67 is pushed by a component force Nx of a normal force N generated by the inner wall 581 of the slot 63, so that the plug portion 67 can be separated from the slot 63 in a X direction. That is, as the power cable 60 is pulled accidentally, the plug 62 can separate from the connector 58 automatically because a structural design of the plug 62 and the connector 58, so as to prevent solder joints of the connector 58 and the circuit board 54 from being damaged, resulting in damaging all the circuit board 54.

In general, the plug portion 67 can be connected to the slot 63 well because of a tight fit between the plug portion 67 and the slot 63 or because of a resilient structure of the second conductive portion 589. However, in other embodiment, the electronic device 50 can further include at least one fixing component disposed between the connector 58 and the plug 62 for increasing stability of connection of the connector 58 and the plug 62, so as to ensure that the plug 62 is going to separate from the connector 58 as the external force dragging the plug 62 is over the lateral force F. One implementation of the at least one fixing component is designed as an engaging structure of pits and bumps, or as another embodiment of the present invention, as shown in FIG. 2 and FIG. 6. At least one magnetic attractive component 64 is disposed on one of the connector 58 and the plug 62, and a corresponding magnetic component 66 is disposed on the other one of the connector 58 and the plug 62. In this embodiment, the magnetic attractive component 64 is disposed on the plug 62 near the plug portion 67, so as to generate the magnetic effect with the metal casing of the connector 58 to increase the stability of connection of the connector 58 and the plug 62. In addition, the corresponding magnetic component 66 can be disposed on the casing 52 near the connector 58. In this embodiment, the magnetic attractive component 64 can be a magnet or a substance containing iron, such as an iron component, and the corresponding magnetic component 66 also can be the magnet or the substance containing iron. That is, the magnetic attractive component can be disposed on the plug 62 or on the connector 58 for increasing the stability of connection of the connector 58 and the plug 62. As the magnetic attractive component, such as the magnet, is disposed on the casing 52 or on the connector 58, the corresponding magnetic component on the plug 62 can be the plug portion 67 containing iron, so that it does not need to dispose additional magnet or iron component on the plug 62. In contrast, as the magnetic attractive component, such as the magnet, is disposed on the plug 62, the corresponding magnetic component on the connector 58 can be the metal casing, and it does not need to dispose additional magnet or the iron component on the connector 58.

In contrast to the prior art, the plug of the electronic device of the present invention is able to separate from the connector automatically as the plug is inserted into the connector and being pulled by the external force because of structural design of the conical plug portion of the plug and the conical slot of the connector. Therefore, it solves the conventional problem that the solder joints of the connector and the circuit board are damaged because the conventional plug connected to the power cable drags the connector by the lateral force as the power cable is pulled accidentally.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A connector assembly, comprising:

a connector disposed on a circuit board, the connector comprising an insulating socket with a slot, the slot comprising an inner first end and an outer second end, and an inner diameter of the second end of the slot being greater than an inner diameter of the first end of the slot; and a plug connected to an end of a power cable for plugging into the connector, the plug comprising an insulating portion and a plug portion exposed outside the insulating portion, the plug portion comprising a first end close to the insulating portion and a second end far away from the insulating portion, and an outer diameter of the first end of the plug portion being greater than an outer diameter of the second end of the plug portion;

wherein a shape formed between the first end and the second end of the plug portion of the plug conforms to a shape formed between the second end and the first end of the connector, so that the plug portion of the plug is complementarily inserted into the slot of the connector to be located, at least one conductive portion protrudes into the slot in a concentric manner such that insertion of the plug portion into the slot results in the plug portion being sandwiched between the at least one conductive portion and an inner wall of the connector.

2. The connector assembly of claim 1, wherein the plug portion of the plug is formed as a conical shape.

3. The connector assembly of claim 2, wherein a radial section of the plug portion is a circular section.

4. The connector assembly of claim 1, further comprising at least one fixing component disposed between the connector and the plug for increasing stability of connection of the connector and the plug.

5. The connector assembly of claim 4, wherein the at least one fixing component comprises at least one magnetic attractive component disposed on one of the connector and the plug, and a corresponding magnetic component disposed on the other one of the connector and the plug.

6. The connector assembly of claim 5, wherein the magnetic attractive component is a magnet or a substance containing iron, and the corresponding magnetic component is a magnet or a substance containing iron.

7. The connector assembly of claim 1, wherein a first conductive portion and at least one second conductive portion are formed inside the slot of the connector, the first conductive portion and the at least one second conductive portion are separated from each other, a third conductive portion and a fourth conductive portion are formed on the plug portion of the plug, the third conductive portion and the fourth conductive portion are separated from each other, and the first conductive portion and the at least one second conductive portion contact the third conductive portion and the fourth conductive portion respectively as the plug portion is inserted into the slot.

8. The connector assembly of claim 7, wherein the at least one second conductive portion is a metal clip.

9. The connector assembly of claim 7, wherein the first conductive portion is a socket structure, the at least one second conductive portion is a clip structure around the first conductive portion, the third conductive portion is a pin structure, the fourth conductive portion is a conical structure around the third conductive portion, and the third conductive portion is inserted into the first conductive portion and the at least one second conductive portion resiliently presses the fourth conductive portion as the plug portion is inserted into the slot so that the first conductive portion and the at least one second conductive portion tightly contact the third conductive portion and the fourth conductive portion respectively.

10. An electronic device, comprising:

a casing;

a circuit board disposed inside the casing; and a connector assembly, comprising:

a connector disposed on the circuit board, the connector comprising an insulating socket with a slot, the slot comprising an inner first end and an outer second end, and an inner diameter of the second end of the slot being greater than an inner diameter of the first end of the slot; and a plug connected to an end of a power cable for plugging into the connector, the plug comprising an insulating portion and a plug portion exposed outside the insulating portion, the plug portion comprising a first end close to the insulating portion and a second end far away from the insulating portion, and an outer diameter of the first end of the plug portion being greater than an outer diameter of the second end of the plug portion;

wherein a shape formed between the first end and the second end of the plug portion of the plug conforms to a shape formed between the second end and the first end of the connector, so that the plug portion of the plug is complementarily inserted into the slot of the connector to be located, at least one conductive portion protrudes into the slot in a concentric manner such that insertion of the plug portion into the slot results in the plug portion being sandwiched between the at least one conductive portion and an inner wall of the connector.

11. The electronic device of claim 10, wherein the plug portion of the plug is formed as a conical shape.

12. The electronic device of claim 11, wherein a radial section of the plug portion is a circular section.

13. The electronic device of claim 10, further comprising at least one fixing component disposed between the connector and the plug for increasing stability of connection of the connector and the plug.

14. The electronic device of claim 13, wherein the at least one fixing component comprises at least one magnetic attractive component disposed on one of the connector and the plug, and a corresponding magnetic component disposed on the other one of the connector and the plug.

15. The electronic device of claim 14, wherein the magnetic attractive component is a magnet or a substance containing iron, and the corresponding magnetic component is a magnet or a substance containing iron.

16. The electronic device of claim 10, wherein a first conductive portion and at least one second conductive portion are formed inside the slot of the connector, the first conductive portion and the at least one second conductive portion are separated from each other, a third conductive portion and a fourth conductive portion are formed on the plug portion of the plug, the third conductive portion and the fourth conductive portion are separated from each other, and the first conductive portion and the at least one second conductive portion contact the third conductive portion and the fourth conductive portion respectively as the plug portion is inserted into the slot.

17. The electronic device of claim 16, wherein the at least one second conductive portion is a metal clip.

18. The electronic device of claim 16, wherein the first conductive portion is a socket structure, the at least one second conductive portion is a clip structure around the first conductive portion, the third conductive portion is a pin structure, the fourth conductive portion is a conical structure around the third conductive portion, and the third conductive portion is inserted into the first conductive portion and the at least one second conductive portion resiliently presses the fourth conductive portion as the plug portion is inserted into the slot so that the first conductive portion and the at least one second conductive portion tightly contact the third conductive portion and the fourth conductive portion respectively.

* * * * *

UNITED STATES PATENT AND TRADEMARK OFFICE

CERTIFICATE OF CORRECTION

PATENT NO. : 9,093,781 B2
APPLICATION NO. : 14/033531
DATED : July 28, 2015
INVENTOR(S) : Bu Liu It is certified that error appears in the above-identified patent and that said Letters Patent is hereby corrected as shown below:

Title Page, Item (54) and in the Specification, Column 1, lines 1-3, correct the title of the invention from "COMPLEMENTARY CONNECTOR ASSEMBLY EMPLOYING A MAGNETIC FIXING COMPONENT" to --COMPLEMENTARY CONNECTORY ASSEMBLY EMPLOYING A MAGNETIC FIXING COMPONENT--.

Signed and Sealed this
Twelfth Day of January, 2016

Michelle K. Lee

Michelle K. Lee
*Director of the United States Patent and Trademark Office*